US007690334B2

(12) United States Patent
Corduan et al.

(10) Patent No.: US 7,690,334 B2
(45) Date of Patent: Apr. 6, 2010

(54) MULTIFUNCTIONAL MODULE FOR AN INTERNAL-COMBUSTION ENGINE

(75) Inventors: Pascal Corduan, Walbach (FR); Marco Gallino, Turin (IT); Jacques Vetois, Duttlenheim (FR)

(73) Assignee: Mark IV Systemes Moteurs (SAS), Courbevoie (FR)

( * ) Notice: Subject to any disclaimer, the term of this patent is extended or adjusted under 35 U.S.C. 154(b) by 171 days.

(21) Appl. No.: 11/607,101

(22) Filed: Dec. 1, 2006

(65) Prior Publication Data

US 2007/0175416 A1 Aug. 2, 2007

(30) Foreign Application Priority Data

Dec. 1, 2005 (FR) ..... 05 12210

(51) Int. Cl.
*F01P 1/06* (2006.01)
*F02M 25/07* (2006.01)
*F02B 47/08* (2006.01)

(52) U.S. Cl. ..... 123/41.31; 123/568.12

(58) Field of Classification Search ..... 123/41.31, 123/568.12, 568.17, 568.11, 184.61, 184.34; 60/320

See application file for complete search history.

(56) References Cited

U.S. PATENT DOCUMENTS 7,165,539 B2 * 1/2007 Menin et al. ..... 123/568.12
7,234,453 B2 6/2007 Gallino

FOREIGN PATENT DOCUMENTS

| | | | |
|---|---|---|---|
| DE | 103 44 217 | A1 | 4/2005 |
| EP | 1 375 896 | A2 | 1/2004 |
| EP | 1 533 512 | A2 | 5/2005 |
| EP | 1 600 624 | A1 | 11/2005 |
| WO | WO 01/20156 | A1 | 3/2001 |

* cited by examiner

*Primary Examiner*—Michael Cuff
*Assistant Examiner*—Hung Q Nguyen
(74) *Attorney, Agent, or Firm*—Jacobson Holman PLLC

(57) ABSTRACT

The present invention relates to a multifunctional module for an internal-combustion engine, forming a structural assembly and incorporating the functions of cooling the exhaust gases, regulating the re-injection of the exhaust gases and regulating, at least in part, the circulation flows in the cooling circuit of said engine, said structural assembly being in the form of a constructional and functional unit intended to be fitted to the engine block and incorporating, on the one hand, at least a portion of an exhaust gas recirculation circuit and a heat exchanger for cooling said gases and, on the other hand, at least a portion of the engine cooling circuit, with at least the water-outlet housing, multifunctional module characterised in that the heat exchanger has a tank arranged in the region of an end of the constructional and functional unit and made from a synthetic thermoplastic material.

15 Claims, 8 Drawing Sheets

MULTIFUNCTIONAL MODULE FOR AN INTERNAL-COMBUSTION ENGINE

The present invention relates to the field of motor vehicle parts and equipment, more particularly to the peripheral or accessory systems of the internal-combustion engines of vehicles of this type, and concerns a multifunctional module.

BACKGROUND OF THE INVENTION

Nowadays, the space available under the bonnet of vehicles is more and more limited, in particular around the engine block, and calls for integration of the functions to be performed in order to reduce the overall size, while at the same time maintaining the quality and continuity of execution, on which the reliability of the vehicle depends.

Moreover, in terms of the development and manufacture of internal-combustion-engine vehicles, the current tendency is to streamline, not in terms of isolated elements, i.e. components or parts, but in terms of assemblies, units or modules, each performing a global function or a plurality of interdependent functions.

This is the case, in particular, with the functions associated both with the engine cooling circuit and with the recirculation or the re-injection of the exhaust gases EGR.

It would, of course, be advantageous, in terms of both compactness and a reduction in overall size and in terms of a reduction in the number of parts and assembly and fitting processes, to incorporate, for example, at least some of the functions for the regulation and distribution of the cooling liquid as it leaves the engine block with the function of cooling the gases to be recycled, in order to achieve a single structural unit performing these various functions.

Moreover, if such a unit could also incorporate conduit portions of the respective circulation circuits, it would be possible further to reduce the number of separate parts also required, as well as the length of the corresponding circuits, allowing rapid heating of the engine, for example, to be achieved after a cold start.

Moreover, to achieve a compact installation, not requiring a particular support structure to hold the installation beneath the bonnet of the vehicle, it would be beneficial to fix a unit of this type directly to the engine block.

Finally, it is also advantageous, for financial reasons, to make at least some of the constituent parts of such a unit from a plastics material, although this material should be protected from excessively elevated temperatures.

SUMMARY OF THE INVENTION

The present invention has for its aim to meet at least some of the above-mentioned expectations, some of which have conflicting requirements.

To this end, the present invention has for its object a multifunctional module for an internal-combustion engine, forming a structural assembly and incorporating the functions of cooling the exhaust gases, regulating the re-injection of the exhaust gases and regulating, at least in part, the circulation flows in the cooling circuit of said engine, said structural assembly being in the form of a constructional and functional unit intended to be fitted to the engine block and incorporating on the one hand, at least a portion of an exhaust gas recirculation circuit and a heat exchanger for cooling said gases and, on the other hand, at least a portion of the engine cooling circuit, with at least the water-outlet housing, multifunctional module characterised in that the heat exchanger has a tank arranged in the region of an end of the constructional and functional unit and made from a synthetic thermoplastic material.

BRIEF DESCRIPTION OF THE DRAWINGS

The invention will be better understood by the following description, which relates to a preferred embodiment, given by way of a non-limiting example, and explained with reference to the accompanying schematic drawings, in which.

DETAILED DESCRIPTION OF THE DRAWINGS

Figure 1:
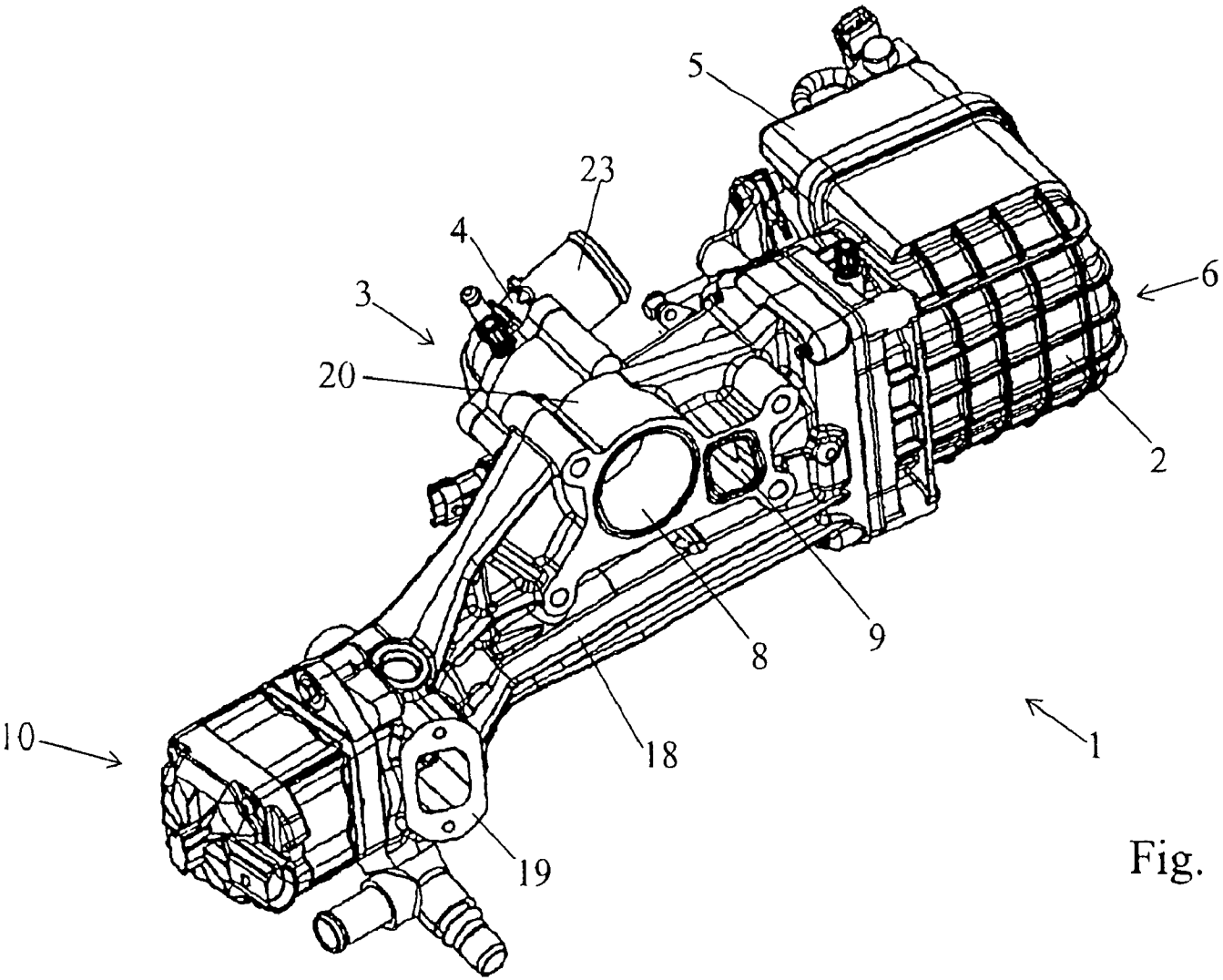
FIGS. 1 and 2 are perspective views from two different angles of a multifunctional module according to the invention.

The accompanying figures illustrate a multifunctional module for an internal-combustion engine, forming a structural assembly and incorporating the functions of cooling the exhaust gases, regulating the re-injection of the exhaust gases and regulating, at least in part, the circulation flows in the cooling circuit of said engine, said structural assembly being in the form of a constructional and functional unit 1 intended to be fitted to the engine block and incorporating, on the one hand, at least a portion of an exhaust gas recirculation circuit and a heat exchanger 2 for cooling said gases and, on the other hand, at least a portion of the engine cooling circuit, with at least the water-outlet housing 3. According to the invention, said multifunctional module is characterised in that the heat exchanger 2 has a tank 6 arranged in the region of an end of the constructional and functional unit 1 and made from a synthetic thermoplastic material.

The provisions set out above provide a compact multifunctional module 1, which is capable of being fixed directly to the engine block and the occupied volume of which may, in particular as a result of the fact that the tank 6 of the heat exchanger 2 is made from a thermoplastic synthetic material, be adapted as a function of the available volume beneath the bonnet of the vehicle into which said module is integrated.

The tank 6 of the heat exchanger 2 may have, in the region of its outer and/or inner wall, rigidifying walls 31 for increasing the mechanical strength of said tank 6. Preferably, as illustrated more particularly in FIGS. 1 and 3, these rigidifying walls 31 are arranged solely over the outer wall of the tank 6, so as not to disturb the circulation of the liquid in the tank 6.

According to a first characteristic of the invention, a submodule 5, in the form of a hollow body, which forms a vacuum reservoir or the internal volume of which may be subjected to reduced pressure, may be provided in the region of the heat exchanger 2, preferably being associated with its tank 6, wherein this sub-module 5 may be used for controlling or supplying with power or with pneumatic energy at least one member 15, 10 for regulating the stream of gas and/or flow of liquid of a pneumatic or electropneumatic type.

This measure has the advantage of further limiting the volume occupied by the constructional and functional unit 1 according to the invention. There is therefore no need to integrate a specific additional reservoir or module into the space in the bonnet of the vehicle reserved for the constructional and functional unit 1, nor to provide specific fixing devices. Moreover, the provision of a tank 6 made from a synthetic material also opens up further possibilities in terms of adapting the shape of the tank 6 of the heat exchanger 2 for receiving the sub-module 5, which forms a vacuum reservoir or the internal volume of which may be subjected to reduced pressure.

Figure 2:
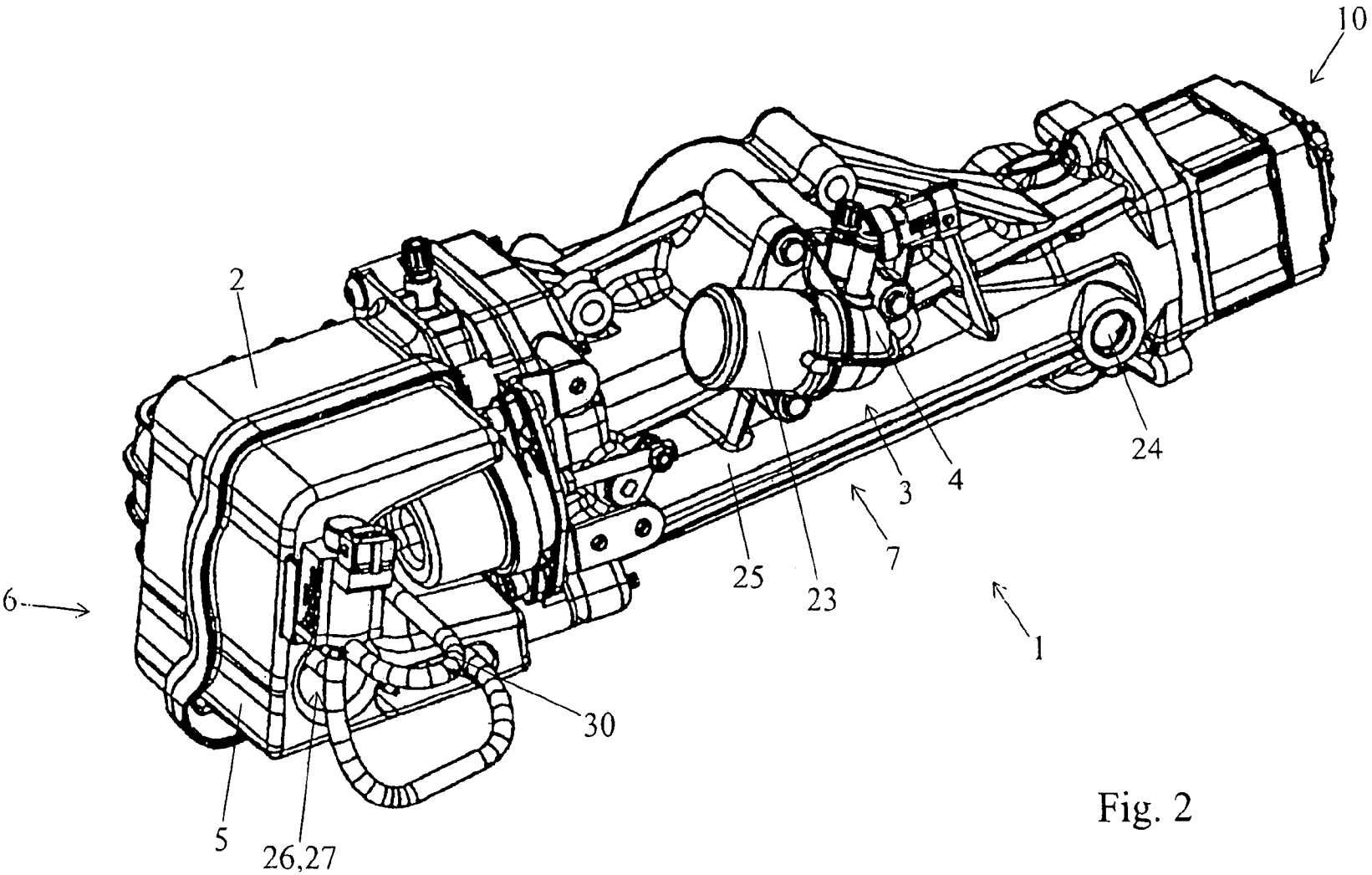

The multifunctional module may also comprise a member 4 for thermostatically regulating the flow of liquid into the water-outlet housing 3, wherein this flow may be discharged in the region of a water-outlet fitting 23 fitted to said water-outlet housing (cf FIG. 2).

Characteristically, the constructional and functional unit 1 according to the invention may be substantially elongate and be basically formed by assembling four elements, i.e. a central one-piece element 7, which comprises, in particular on the same face, a cooling water inlet 8 and an exhaust gas inlet 9, which, for the direct fitting of the module 1 on the engine block, are connected to the engine cooling circuit and to the gas recirculation circuit respectively, the heat exchanger 2, the sub-module 5, a member 10 for regulating/diverting the gas stream, the tank 6 of the heat exchanger 2 and the member 10 for regulating/diverting the gas stream each being fitted, in an opposing manner, in the region of an assembly end of the central element 7.

Owing to the configuration of the various components on the constructional and functional unit and owing to the positioning of the cooling water outlet 8 and the exhaust gas outlet 9 on a single face of said unit, the constructional and functional unit 1 may be fitted directly to the engine without connecting pipes or the like having to be used. Moreover, as will be described in greater detail below, since the constructional and functional unit 1 according to the invention contains a portion of the exhaust gas recirculation circuit and a portion of the engine cooling circuit, it allows maximum optimisation of the space occupied beneath the bonnet.

Figure 3:
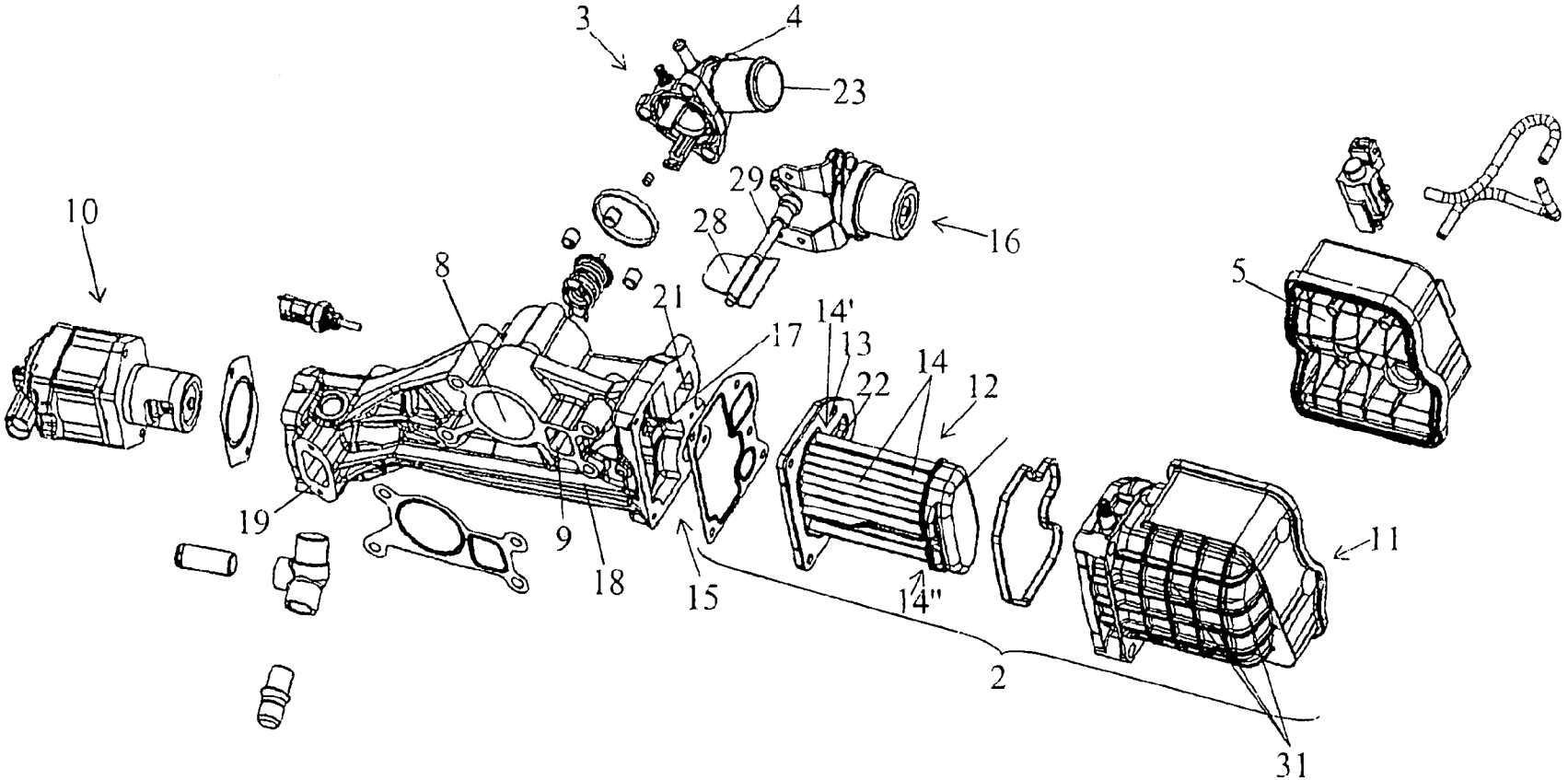
FIG. 3 is an exploded perspective view of the multifunctional module of FIGS. 1 and 2.
Figure 4:
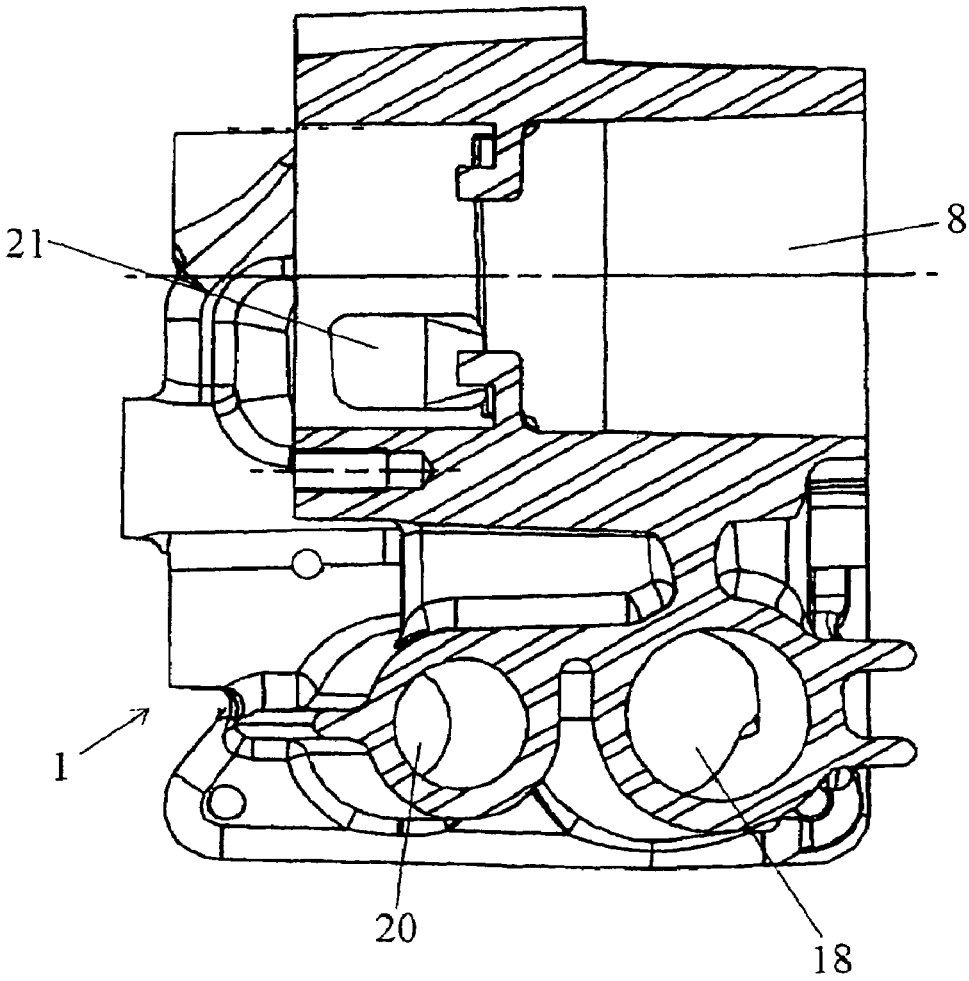
FIG. 4 is a cross-sectional view of the multifunctional module of FIGS. 1 and 2, taken in the region of the water outlet.
Figure 5:
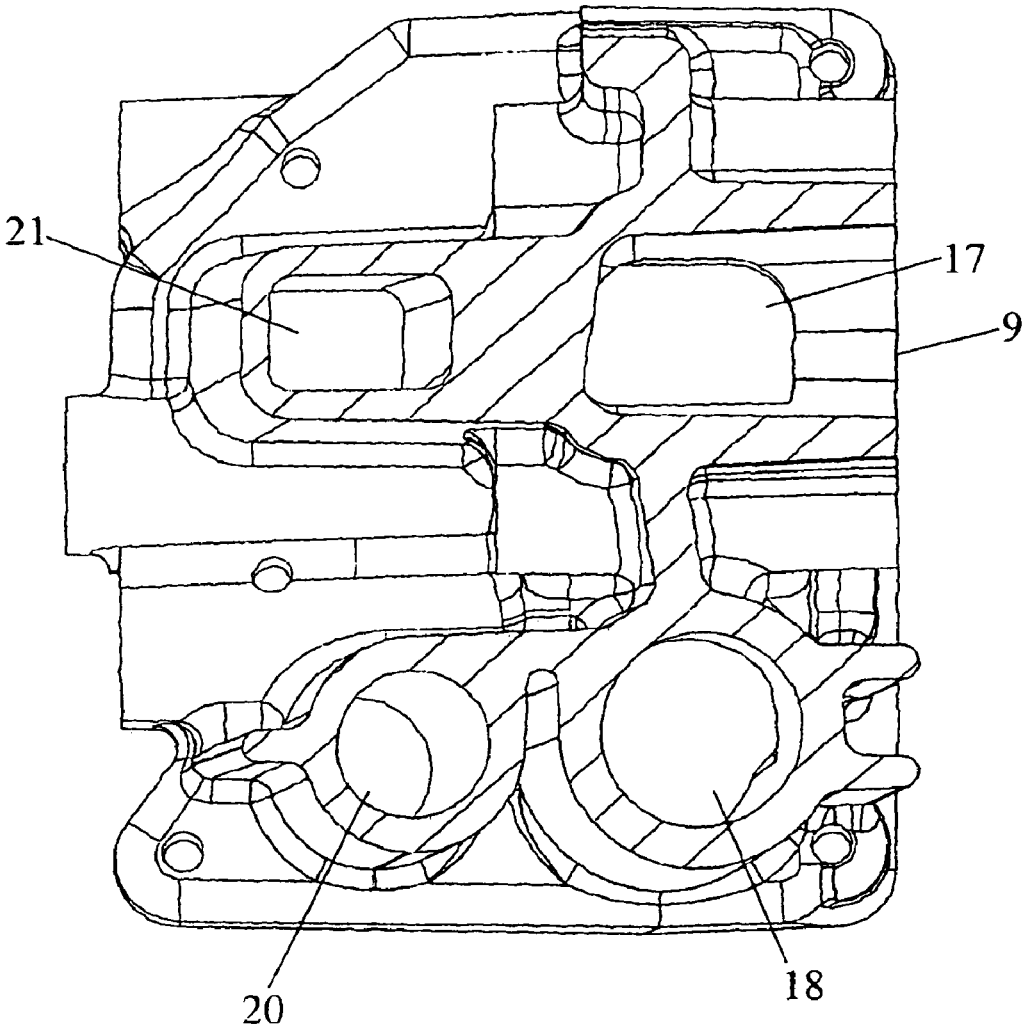
FIG. 5 is a cross-sectional view of the multifunctional module of FIGS. 1 and 2, taken in the region of the gas outlet.
Figure 6:
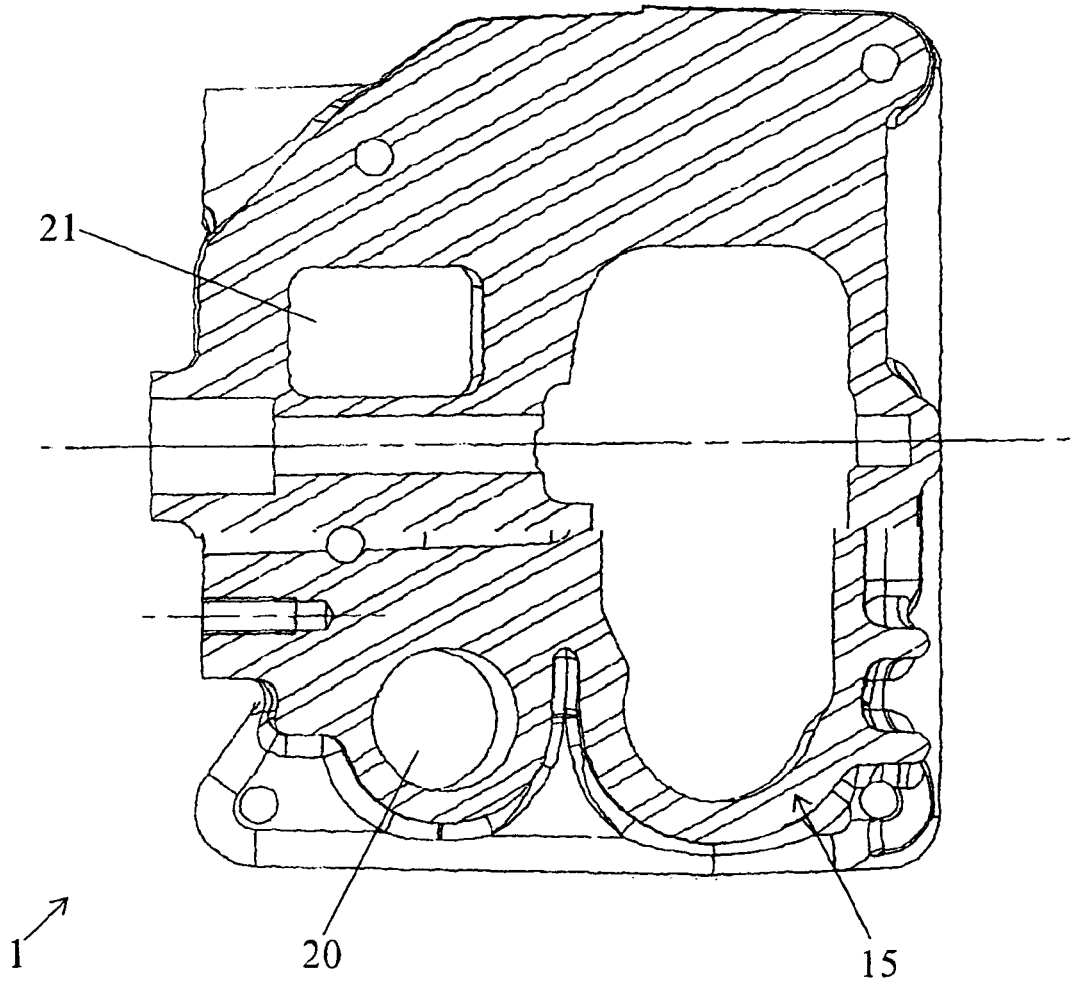
FIG. 6 is a cross-sectional view of the multifunctional module of FIGS. 1 and 2, taken in the region of the exhaust gas distribution chamber.
Figure 7:
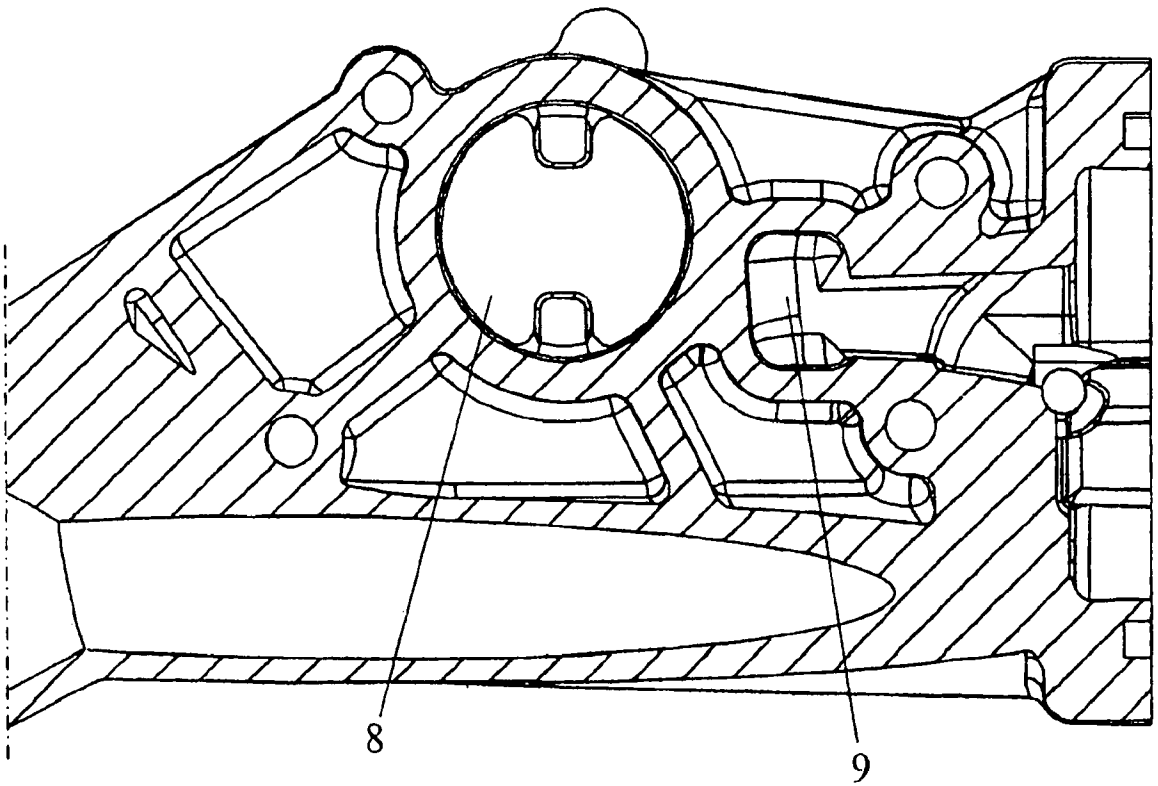
FIG. 7 is a longitudinal section of the multifunctional module of FIGS. 1 and 2, taken in the region of the water outlet and the gas outlet.

According to the invention, as illustrated in FIG. 3, the heat exchanger 2 may have a tank 6 in the form of a hollow body 11, in which a bundle 12 of tubes 14 is fitted and positioned using a support element 13, said support element 13 also providing tightness in the region of the assembly interface between said hollow body 11 and the central element 7 and closing the tank 6 of the heat exchanger 2, and the bundle 12 of tubes 14 may form a U-shaped circulation path for the exhaust gases in the tank 6 and consist of a first group of outward tubes 14, in which the exhaust gases circulate from the first end 14' of the tubes 14, located in the region of the opening in the tank 6 and the support element 13, toward the second end 14" of the tubes 14, located in the region of the base of the tank 6, and of a second group of return tubes 14, in which the exhaust gases circulate from the second end 14" of the tubes 14, located in the region of the base of the tank 6, toward the first end 14' of the tubes 14, located in the region of the opening in the tank 6 and the support element 13.

Advantageously, the heat exchanger 2 is positioned in proximity to the gas outlet 9 in such a way that the hot exhaust gases do not pass through the multifunctional module 1 over a long distance, thus preventing an excessive increase in temperature caused by the exhaust gases issuing from the engine and admitted directly into said multifunctional module 1.

According to a preferred embodiment of the invention, the second ends 14" of the tubes 14 open into a common volume providing fluid communication between the first group and the second group of tubes 14, said volume being formed, for example, by a shell closed by a plate, the second ends 14" of the tubes 14 passing through said plate. The exhaust gases are thus cooled during the circulation thereof in the tubes 14, both in the direction of displacement toward the common volume, i.e. in the first group of outward tubes 14, and in the opposite direction, i.e. in the second group of return tubes 14.

According to one variation of the invention, the tubes 14 of the heat exchanger 2 may be in one piece and curved in the shape of a U.

According to another variation, the tubes 14 may each consist of two straight tube portions interconnected by a curved tube portion.

As described above, the heat exchanger 2 of the multifunctional module 1 has a sub-module 5, which forms a vacuum reservoir or the internal volume of which may be subjected to reduced pressure. This sub-module may supply members 15, 10 for regulating the stream of gas and/or flow of liquid of a pneumatic or electropneumatic type with power or pneumatic energy.

The present invention provides two variations of this sub-module 5. According to the first of said variations, the tank 6 of the heat exchanger may be in one piece and contain two compartments separated by a tight wall, the first compartment forming the hollow body 11, in which the tubes 14 are fitted, and the second compartment forming the sub-module 5 containing a vacuum reservoir.

The second of said variations provides that the assembly formed by the tank 6 of the heat exchanger and the hollow body of the sub-module 5 may consist of two half-shells 11 and 5 joined together, preferably by vibration welding, at least one of said half-shells 11 and 5 having a closing wall forming a partition wall between the tank 6 and the hollow body forming the sub-module 5.

In both cases, two tight volumes, one of which is intended to receive the tubes 14 and the other of which is intended to form a vacuum reservoir, are thus obtained. Advantageously the sub-module 5 forming the vacuum reservoir may, owing to the fact that pressurised air may be stored in any volume, have any shape capable of being adapted to the overall size beneath the bonnet. Moreover, the wall of the heat exchanger 2 or the half-shell of the sub-module may be made from an injection-moulded thermoplastic material, thus further broadening the range of possible shapes that the heat exchanger 2 and/or the sub-module 5 may adopt.

According to a characteristic of the invention, the inlet and outlet ends of the tubes 14 may be in fluid relationship with an exhaust gas distribution chamber 15 formed in the central element 7 and incorporating a member 16 for regulating and/or diverting the gas stream, said chamber itself being in fluid relationship with two gas ducts 17 and 18, which open into the gas inlet 9 and a gas outlet 19 respectively located on the central element 7.

The member 16 for regulating and/or diverting the gas stream is intended to organise the circulation of the gases in the central element 7 of the multifunctional module 1 and to check the degree of cooling of the module. This member 16 checks the intake of gases in the region of the openings in the inlet ends of the tubes 14.

The member 16 therefore allows the rate of, more or less cooled, exhaust gas re-injected into the intake manifold (not shown) via the duct 18 to be monitored.

According to a characteristic of the invention, the outlet 19 may therefore be arranged in the region of the constructional and functional unit 1 in such a way that when the unit is fitted to an engine, said outlet 19 is in a position for direct fitting to the intake manifold of the engine. This arrangement further limits the space occupied by the multifunctional module 1 and its connecting devices.

Figure 8:
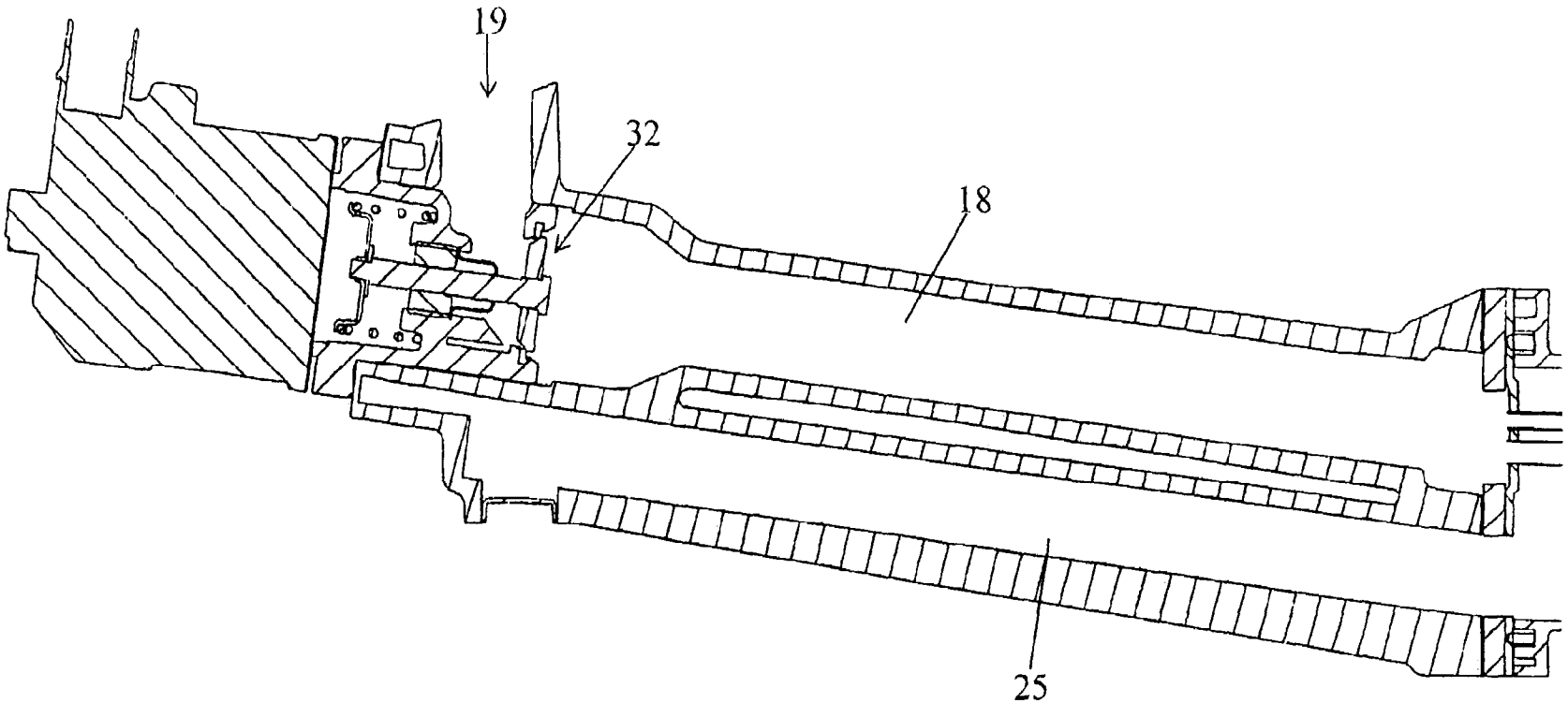
FIG. 8 is a longitudinal section of the multifunctional module of FIGS. 1 and 2, taken in the region of the member for regulating/diverting the gas stream.

As illustrated in FIG. 9, the member 10 for regulating/diverting the gas stream may regulate the gas stream in the region of the outlet 19 via a valve element 32, which, as may be seen from FIG. 8, is movable in translation and is intended to close, in a controlled manner, the passage section between the duct 18 and the outlet 19.

As shown in FIGS. 1 and 2, the cooling water inlet 8 may be fluidically connected, on the one hand, to the water-outlet housing 3 via a conduit 20, which is formed in the central element 7 and is perpendicular to the longitudinal axis of said element, and, on the other hand, to the tank 6 of the heat exchanger 2 via a duct 21, which opens, in the fitted state of the module 1, into a corresponding opening 22 formed in a portion 13' in the form of a planar frame of the support element 13, which, in the fitted state of the module 1, is sandwiched between the assembly edges of the tank 6 of the heat exchanger 2 and those of the central element 7, and said portion 13' of the support element 13 may have a second opening (not shown) for the passage of water issuing from the tank 6 of the heat exchanger 2 toward an outlet formed in the central element 7, via a duct 25.

The central element 7 therefore has a favoured direction for the circulation of exhaust gases and cooling water, i.e. its longitudinal direction This arrangement of the ducts simplifies the structure of said central element 7, so it may be produced by injection-moulding.

In order to place the air volume contained in the sub-module 5 under negative pressure, it may be provided that the outer wall of the sub-module 5, which contains a vacuum reservoir, has a fitting 26 for connection to a device for drawing in the air volume contained in said module. Moreover, in order to use this reserve of air under negative pressure for supplying at least one member 15, 10 for regulating the gas stream and/or liquid flow with pneumatic energy or power, said outer wall may also have at least one fitting 27 for connection to a device for activating a member for regulating the stream of gas and/or flow of water in the module 1.

In the embodiment illustrated in the accompanying figures, the member 16 for regulating/diverting the gases in the exhaust gas distribution chamber 15 is therefore in the form of a valve 28, which is rotationally fixed to a shaft 29, which is driven in rotation by a ball-and-socket joint 30 controlled by an activating device, which is connected to the vacuum reservoir of the sub-module 5 via a pipe connected to said fitting 27.

The pneumatic energy of the member 15 for regulating diverting the gases is therefore advantageously supplied by the sub-module 5, which forms a vacuum reservoir or the internal volume of which may be subjected to reduced pressure.

The invention is not, of course, limited to the embodiment described and illustrated in the accompanying drawings. Modifications are possible, in particular with regard to the constitution of the various elements or by substitution of technical equivalents, without thereby departing from the scope of protection of the invention.

The invention claimed is:

1. A multifunctional module for an internal-combustion engine comprising a structural assembly for cooling exhaust gases, regulating a re-injection of the exhaust gases and regulating circulation flows in a cooling circuit of said engine, said structural assembly being a constructional and functional unit configured to be fitted to the engine and including at least a portion of an exhaust gas recirculation circuit and a heat exchanger for cooling said gases and at least a portion of the engine cooling circuit with at least a water-outlet housing, the heat exchanger having a tank constructed of a synthetic thermoplastic material and arranged in a region of an end of the constructional and functional unit, and a sub-module in a form of a hollow body which provides a vacuum reservoir or an internal volume of which may be subjected to reduced pressure, the sub-module being provided in a region of the heat exchanger, being associated with the tank, and being used for controlling or supplying with power or with pneumatic energy at least one member for regulating a stream of gas and/or flow of liquid of a pneumatic or electropneumatic type.

2. The module according to claim 1, further comprising a member for thermostatically regulating the flow of liquid into the water-outlet housing.

3. The module according to claim 1, wherein the functional unit is substantially elongate and has four assembled elements including a central one-piece element, which has on a same face, a cooling water inlet and an exhaust gas inlet, which, for direct fitting of the module on the engine, are connected to the engine cooling circuit and to the gas recirculation circuit respectively, the heat exchanger, the sub-module, and a member for regulating/diverting the gas stream, with the tank of the heat exchanger and the member for regulating/diverting the gas stream each being fitted, in an opposing manner, in a region of an assembly end of the central element.

4. The module according to claim 3, wherein the heat exchanger tank is configured as a hollow body, in which a bundle of tubes is fitted and positioned using a support element, said support element also providing tightness in a region of an assembly interface between said hollow body and the central element and closing the tank of the heat exchanger, and the bundle of tubes forming a U-shaped circulation path for the exhaust gases in the tank and having a first group of outward tubes, in which the exhaust gases circulate from a first end of the tubes, located in a region of an opening in the tank and the support element, toward a second end of the tubes, located in a region of a base of the tank, and of a second group of return tubes, in which the exhaust gases circulate from the second end of the tubes, located in the region of the base of the tank, toward the first end of the tubes, located in the region of the opening in the tank and the support element.

5. The module according to claim 4, wherein the second ends of the tubes open into a common volume providing fluid communication between the first group and the second group of tubes, said volume being formed by a shell closed by a plate, the second ends of the tubes passing through said plate.

6. The module according to claim 4, wherein the tank of the heat exchanger is configured as one piece and contains two compartments separated by a tight wall, the first compartment forming the hollow body, in which the tubes are fitted, and the second compartment forming the sub-module containing the vacuum reservoir.

7. The module according to claim 4, wherein the assembly formed by the tank of the heat exchanger and the hollow body of the sub-module includes two half-shells joined together by vibration welding, at least one of said half-shells having a closing wall forming a partition wall between the tank and the hollow body forming the sub-module.

8. The module according to claim 4, wherein the inlet and outlet ends of the tubes are in fluid relationship with an exhaust gas distribution chamber formed in the central element and incorporating a member for regulating and/or diverting the gas stream, said chamber being in fluid relationship with two gas ducts, which open into the gas inlet and a gas outlet respectively located on the central element.

9. The module according to claim 8, wherein the outlet is arranged in a region of the constructional and functional unit such that when the unit is fitted to the engine, said outlet is in a position for direct fitting to the engine.

10. The module according to claim 8, wherein the cooling water inlet is fluidically connected to the water-outlet housing via a conduit, which is formed in the central element and is perpendicular to a longitudinal axis of said element, and to the tank of the heat exchanger via a duct, which opens, in a fitted state of the module, into a corresponding opening formed in a portion as a planar frame of the support element, which, in the fitted state of the module, is sandwiched between assembly edges of the tank of the heat exchanger and edges of the central element, and said portion of the support element has a second opening for the passage of water issuing from the tank of the heat exchanger toward an outlet formed in the central element, via a duct.

11. The module according to claim 1, wherein the outer wall of the sub-module, which contains a vacuum reservoir, has a fitting for connection to a device for drawing in the air volume contained in said module, and at least one fitting for connection to a device for activating a member for regulating the stream of gas and/or flow of water in the module.

12. The module according to claim 11, wherein the member for regulating/diverting the gases in the exhaust gas distribution chamber is configured as a valve, which is rotationally fixed to a shaft, which is driven in rotation by a ball-and-socket joint controlled by an activating device, which is connected to the vacuum reservoir of the sub-module via a pipe connected to said fitting.

13. A multifunctional module for an internal-combustion engine comprising:

a structural assembly for cooling exhaust gases, regulating a re-injection of the exhaust gases and regulating circulation flows in a cooling circuit of said engine, said structural assembly being a constructional and functional elongated unit configured to be fitted to the engine and including at least a portion of an exhaust gas recirculation circuit and a heat exchanger for cooling said gases and at least a portion of the engine cooling circuit with at least a water-outlet housing that includes a thermostatic valve and a discharge fitting, the heat exchanger being located at a longitudinal end of the unit and having a tank constructed of a synthetic thermoplastic material and arranged in a region of the end of the constructional and functional unit; and a sub-module configured as a hollow body that provides a vacuum reservoir or an internal volume which can be subjected to reduced pressure, the sub-module being provided in a region of the heat exchanger that is associated with the tank and being used to control or supply with power or with pneumatic energy a member that regulates a stream of gas and/or flow of liquid.

14. The module according to claim 13, wherein the thermostatic valve regulates the flow of a liquid into the water-outlet housing.

15. The module according to claim 13, wherein the member is configured for pneumatic or electropneumatic operation.

* * * * *